United States Patent [19]

Marass

[11] 4,089,517

[45] May 16, 1978

[54] SHEET FEEDER WITH CORRECTION FOR SHEET OFFSET

[75] Inventor: Josef Marass, Seehausen, Germany

[73] Assignee: Georg Spiess GmbH, Gersthofen, Germany

[21] Appl. No.: 733,789

[22] Filed: Oct. 19, 1976

[30] Foreign Application Priority Data

Oct. 24, 1975 Germany ..... 2547788

[51] Int. Cl.[2] ..... B65H 7/12

[52] U.S. Cl. ..... 271/13; 271/227; 271/254

[58] Field of Search ..... 271/13, 15, 17, 196, 271/226–228, 241, 248–255, 276, 107

[56] References Cited

U.S. PATENT DOCUMENTS

| | | | |
|---|---|---|---|
| Re. 18,463 | 5/1932 | Goss | 271/226 X |
| 1,353,088 | 9/1920 | Swift, Jr. | 271/251 |
| 2,167,823 | 8/1939 | Backhouse | 271/250 |
| 3,519,266 | 7/1970 | Blake et al. | 271/251 |
| 3,663,011 | 5/1972 | Mowry et al. | 271/276 X |
| 3,743,277 | 7/1973 | Hans-Bernhard et al. | 271/250 X |

FOREIGN PATENT DOCUMENTS

| | | | |
|---|---|---|---|
| 744,879 | 5/1957 | United Kingdom | 271/107 |

*Primary Examiner*—Robert W. Saifer
*Attorney, Agent, or Firm*—Webb, Burden, Robinson & Webb

[57] ABSTRACT

A top-sheet feeder in which the feed table comprising suckers engaging a sheet fed from the top of the stack, is pivotable to position the input end of the feed table at any offset position the sheet may have occupied at the top of the stack; the feed table comprising an end portion to direct the suckers upstream of the pivot normal to the leading edge of the sheet and thus align them correctly for output from the feeder.

2 Claims, 5 Drawing Figures

SHEET FEEDER WITH CORRECTION FOR SHEET OFFSET

The invention relates to a sheet feeder by means of which the lateral position of the sheets fed from a stack of sheets offset from the vertical can be corrected. Sheet stacks handled by sheet feeders frequently have a considerable degree of vertical offset of some 100 mm or more which renders it impossible to handle the stack without lateral correction, and the interruption caused thereby, since the side guides or marks employed provided for lateral register can only rectify a minor amount of offset of a few millimeters.

German Patent Specification No. 2,200,755 describes a system which compensates for the offset by automatic lateral displacement of the entire stack during the running of the machine such that the topmost sheets always enter into the prescribed region of the side marks. However, many difficulties are presented by the displacement of the entire stack which is frequently of considerably weight. The sensing of the top edges of the stack, required for initiating displacement, is uncertainly effected, since in this system mechanical switches have to be actuated by thin sheets which at the time may be floating i.e. detached from the stack. Furthermore, the front edges of the sheets may be damaged when the stack is moved transversely of stops provided in the sheet feeder. Considerable forces, and thus parts of correspondingly large dimensions, are required to effect the lateral movement of the stack. Finally, in the case of non-stop feeders, the stack displacement mechanism can no longer affect the stack once the latter has been received by an auxiliary stack-carrier used in the non-stop feeder.

The object of the invention is to correct the lateral position of the sheets fed from an offset stack of sheets in a simple and reliable manner and at the same time to avoid the aforementioned disadvantages.

In accordance with the present invention, this is achieved in that a sheet conveyor is employed, by which the sheets from the stack are guided over a feed path, such that it can be swung horizontally about a fixed point remote from the input end of the conveyor, transversely of the stack by an amount corresponding to the vertical offset of the sheet to be received by the conveyor from the stack. Thus, the conveyor always delivers a sheet to the same place i.e. the station of the fixed point, while being adjustable to permit the input end of the conveyor to be positioned to receive a sheet from the stack even if the sheet is offset from the vertical line of the stack.

The conveyor may comprise suckers arranged singly or in pairs longitudinally of the feed path for translation therebelow to engage the sheets from below; and the suckers may be mounted to be laterally displaceable and to be guided by a guideway which is pivotally mounted adjacent one end thereof in the end portion of the feed path to be swingable in the horizontal plane and determine by its positioning in that plane, the amount of lateral displacement of the suckers at any place along the feed path. The suckers may be translated by a chain drive, for instance, a pair of chains between which support bars are mounted to carry the suckers so as to be displaceable in the transverse direction of the conveyor.

By virtue of the measure in accordance with the invention, the offset of the sheets can be corrected by simple means, and the sheets are advanced to the side guides or marks with the required accuracy, so that the side marks can effect the final alignment of the sheets. The front edges of the sheets are conveyed at right angles to the normal conveying direction during the entire correction operation, since the conveying means are pivoted, if need be, before the transfer of each sheet from the stack in accordance with the offset of the sheet. Thus, the sheets arrive with the required accuracy at, for example, the front marks of the machine using the sheets fed by the conveyor.

Preferably, the angularly adjustable guideway is pivotable about a pivot point located at a distance from the front edge of the conveyor, so that the sheets are moved in a direction normal to the leading edges over the final portion of the feed path. The angular position of the guideway may be adjusted manually by means of a spindle. For the purpose of automatically correcting the lateral position, the spindle may be operated by means of an auxiliary motor automatically controlled by means of a lateral edge sensor.

An embodiment of the invention will now be described, by way of example only, with reference to the accompanying drawings.

Figure 1:
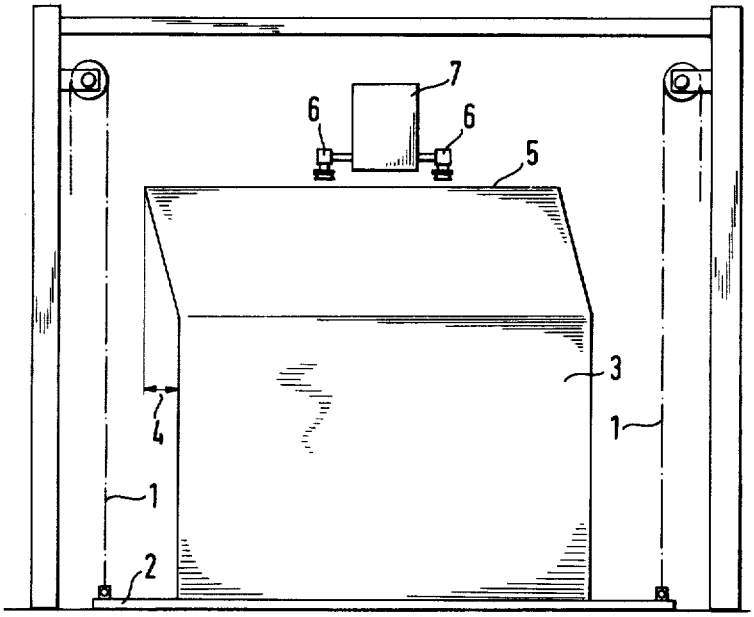
FIG. 1 shows a front view of a feeder in which a stack is located having considerable lateral offset.

Referring now to the drawings, a stack 3 of sheets, the upper part of which is laterally offset as indicated by the arrow 4 in FIG. 1, rests on a support plate 2 suspended on lifting chains 1. The uppermost sheet 5 of the stack is in each case separated from the stack 3 by means of separating and feed suckers 6 of a suction head 7 and is fed to a feed table 11, comprising a conveyor and defining a conveying path, so that a first pair of a plurality of pairs of suckers 9 of the conveyor engage the underside of the front edge of the sheet.

The pairs 9 of suckers guiding the sheets across the feed table 8 are displaceably arranged on support bars 11 whose ends are secured to two endless chains 12 which run parallel to one another and which form the drive for the suckers 9. During their movement across the feed table, the transversely displaceable pairs of suckers are controlled by means of a guide bar 13 which is pivotable about a fixed pivot point 14 to either side of the pivot point. Alternatively, the conveyor may consist of a belt or roller conveyor.

Figure 2:
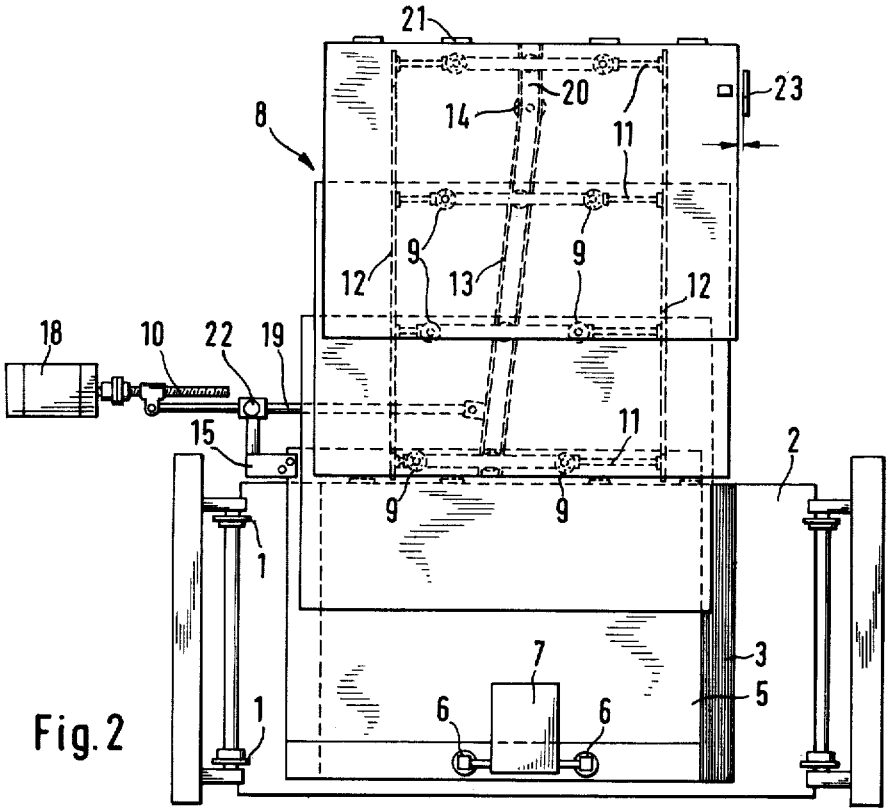
FIG. 2 is a plan view of the feeder showing separating and feed suckers required for separating and feeding the sheets, and an adjacent conveyor.
Figure 3:
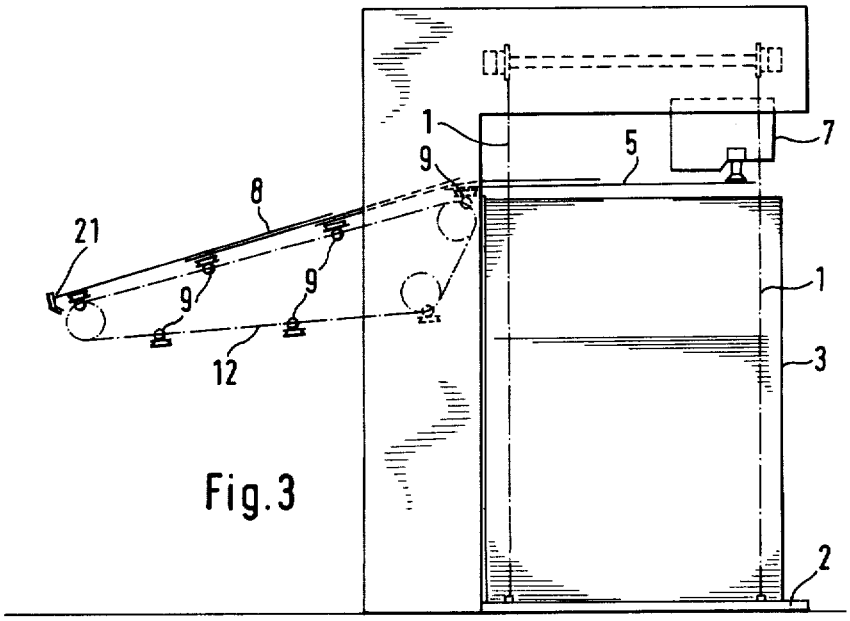
FIG. 3 is a side elevation of the feeder of FIGS. 1 and 2.
Figure 4:
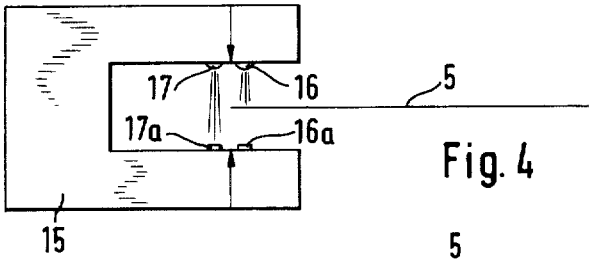
FIGS. 4 and 5 show lateral edge sensor constituted by a light barrier, for scanning the edges of the sheets.
Figure 5:
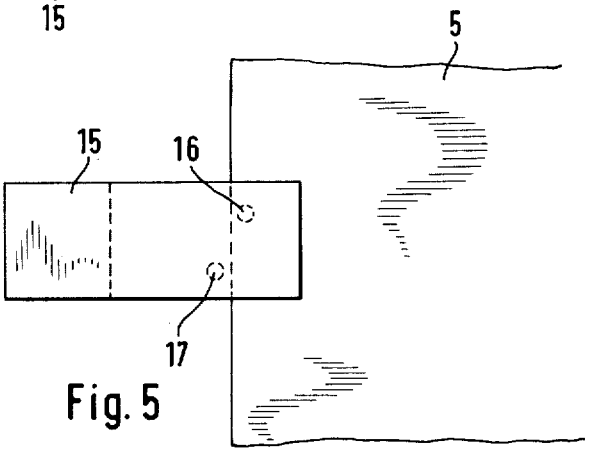

A lateral edge sensor 15 (see especially FIGS. 4 and 5) is provided at the top end of the stack and, in the present case, is in the form of a light barrier which has two light sources 16 and 17 staggered relative to one another. When in the illustrated position, the topmost sheet 5 of the stack breaks only the b am from light source 16 and this represents a reference position in which the motor 18 is unactuated. This means that the guide bar 13 is positioned to correspond to the offset of the top sheet of the stack as shown in FIG. 2. As the degree of offset reduces with removal of sheets, the lateral edge of the top sheet becomes disposed to the right as viewed in FIGS. 4 and 5 and uncovers a light sensor 16*a* associated with light source 16. Thus, a signal is generated to cause the servo-motor 18 to reduce the angle of the guide bar 13 by way of the spindle 10 and the pull rod 19. The lateral edge sensor 15 follows the movement of the pull rod, since it is secured to the latter; the angular adjustment of the guide bar 13 continuing until the edge of the sheet again overlaps the receiver 16*a* of the light source 16 to stop the servo-motor 18.

On the other hand, if the offset of the sheets increases during the course of handling the stack, the lateral edge of the topmost sheet 5 moves to the left, so that the beam from the light source 17 is interrupted. Thus, the servo-motor 18 receives a signal by means of which the angle of traverse of the guide bar 13 is increased until a light sensor 17*a* associated with light source 17 is uncovered by the edge of the sheet. The servo-motor is then stopped again as soon as the edge of the sheet exposes the sensor 17*a*.

It will be evident therefore, that when handling a stack having offset, the lateral edge sensor 15 swings the guide bar 13 laterally to an extent corresponding to the offset of the stack of sheets at the top thereof. Thus, the feed suckers 9 convey the sheet, coming from the stack, towards the processing machine with a simultaneous and uniform movement. Since the pivot point 14 of the guide bar 13 is located at a distance from the front edge of the feed table, the angularly adjustable guide bar 13 merges into guide member 20 which extends normal to the leading edge of a sheet being conveyed so that, shortly before reaching the front marks 21, the sheet effects a movement as a result of which the lateral correction of the sheet has already been completed upon passing the pivot point 14. The conventional side marks responsible for side registration are designated 23 and, as mentioned, they can only adjust a few millimeters of offset.

In order to be able to adjust the device to different widths of sheets, the lateral edge control 15 is adjustable along the pull rod 19, for example by securing it to the rod by means of a clamping sleeve 22.

I claim:

1. A sheet feeder comprising a feed table provided with sheet feeding means for the stream feeding of individual sheets from a stack of sheets over the feed table, conveying means being laterally displaceable towards both sides in the feeding plane with reference to the normal conveying direction for correcting the lateral position of sheets lying in an offset stack, the conveying means comprising laterally displaceable suckers arranged longitudinally of the feed path therebelow to engage a sheet from below, the conveying means comprising a longitudinal guideway pivotally mounted adjacent one end thereof in an end portion of the feed table to be swingable about a pivot in a horizontal plane and determine by its position in that plane the amount of lateral displacement of a sucker at any place along the feed table, the angular position of the guideway being adjustable by a servo-motor acting on a spindle, said conveying means being pivotable in each case before receiving a sheet and according to the lateral offset of the sheets, and a lateral edge sensor for measuring the lateral offset of the sheet to be received by the conveying means and for automatically controlling the servo-motor which in turn adjusts the pivoting movement of the conveying means before each receipt of a sheet in accordance with the lateral offset of the sheet to be received as measured by the lateral edge sensor.

2. A feeder as claimed in claim 1, wherein the lateral edge sensor comprises two photoelectric sensors positioned, and arranged in connection with the motor so that when said guideway is positioned at the position of a sheet to be fed from the stack, the beam of one photoelectric sensor is broken by an edge of the sheet and the motor is inactivated, but so that, when the beams of both photoelectric sensors are broken by said sheet edge, the motor is actuated to pivot the guideway further from the centre line of the feed table to the offset position of the sheet, and so that, when neither beam of the photoelectric sensors is broken, the motor is activated to pivot the guideway further towards the centre line of the feed table to the position of the sheet.

* * * * *